US011120668B1

(12) United States Patent
Hicks et al.

(10) Patent No.: US 11,120,668 B1
(45) Date of Patent: Sep. 14, 2021

(54) DIGITAL SYSTEM AND METHOD TO MANAGE AND FACILITATE PROGRESSIVE KNOCKOUT POKER IN A LIVE TOURNAMENT SETTING

(71) Applicant: PUNT GAMING, LLC, Miami, FL (US)

(72) Inventors: James Eric Hicks, Atlanta, GA (US); Anthony Barbera, Miami, FL (US); Noel Briggs, Miami, FL (US)

(73) Assignee: Punt Gaming, LLC, Miami, FL (US)

( * ) Notice: Subject to any disclaimer, the term of this patent is extended or adjusted under 35 U.S.C. 154(b) by 0 days.

(21) Appl. No.: 16/818,773

(22) Filed: Mar. 13, 2020

(51) Int. Cl.
*G07F 17/32* (2006.01)

(52) U.S. Cl.
CPC ..... *G07F 17/3293* (2013.01); *G07F 17/3223* (2013.01); *G07F 17/3276* (2013.01)

(58) Field of Classification Search
None
See application file for complete search history.

(56) References Cited

U.S. PATENT DOCUMENTS

| | | | | |
|---|---|---|---|---|
| 9,659,448 | B1 * | 5/2017 | Mileski | G07F 17/3244 |
| 10,068,425 | B2 * | 9/2018 | Colvin | G07F 17/3244 |
| 2015/0221183 | A1 * | 8/2015 | Colvin | G07F 17/3241 463/11 |
| 2017/0061731 | A1 * | 3/2017 | Colvin | G07F 17/3211 |

* cited by examiner

*Primary Examiner* — Ronald Laneau
(74) *Attorney, Agent, or Firm* — Berger Singerman LLP; Geoffrey Lottenberg

(57) ABSTRACT

A digital system for managing and tracking knockout poker or progressive knock poker tournament in a live gaming setting. Each tournament entrant has a player device at the table seat. The dealer manages table activity, including bounty and bank roll activity, through a dealer device. A tournament director uses a director device to manage the dealer devices and the player devices. The director devices and dealer devices have higher levels of administrative access as compared to the player devices. The player devices are designed to be visible by all players seated at the gaming table so that each player can be appraised of every other player's current bounty and bank roll status. The dealer can use the dealer device to manage and track the knockout and other aspects of the game by inputting and modifying bounty, bankroll, and other information in response to events occurring the real-time poker game.

19 Claims, 4 Drawing Sheets

DIGITAL SYSTEM AND METHOD TO MANAGE AND FACILITATE PROGRESSIVE KNOCKOUT POKER IN A LIVE TOURNAMENT SETTING

CROSS-REFERENCE TO RELATED APPLICATIONS

N/A

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings, given below, explain the principles of the disclosure.

In the drawings:

FIG. 1 is a system environment, according to an embodiment.

FIG. 2 is a diagram explaining a game management method according to an embodiment.

FIG. 3 is diagram explaining another game management method according to an embodiment.

FIG. 4 is a computing environment, according to an embodiment.

Figure 1:
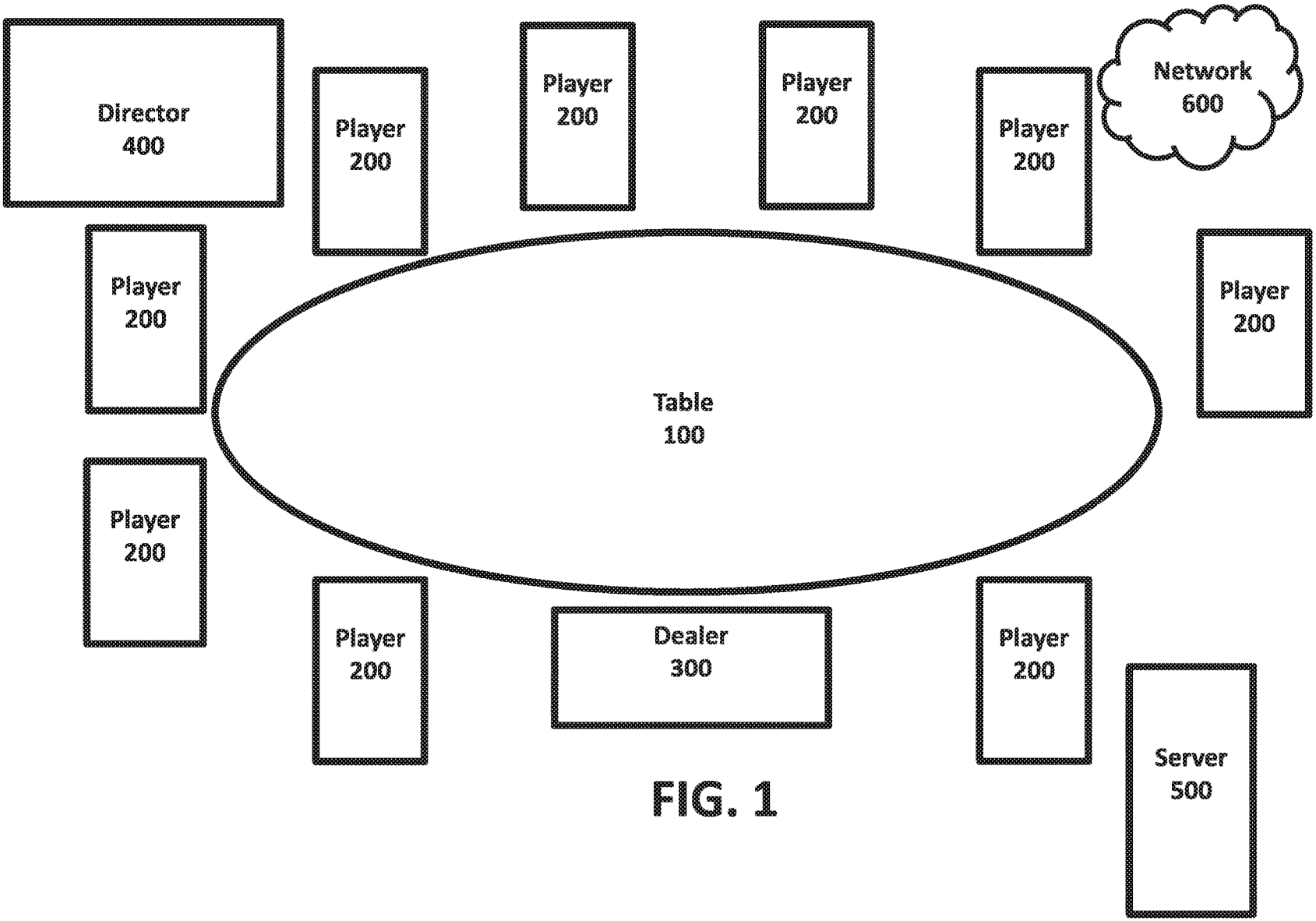

The drawings are not necessarily to scale. In certain instances, details that are not necessary for an understanding of the disclosure or that render other details difficult to perceive may have been omitted. It should be understood, of course, that the disclosure is not necessarily limited to the embodiments illustrated herein.

DETAILED DESCRIPTION

The present invention provides its benefits across a broad spectrum of endeavors. It is applicant's intent that this specification and the claims appended hereto be accorded a breadth in keeping with the scope and spirit of the invention being disclosed despite what might appear to be limiting language imposed by the requirements of referring to the specific examples disclosed. Thus, to acquaint persons skilled in the pertinent arts most closely related to the present invention, a preferred embodiment of the system is disclosed for the purpose of illustrating the nature of the invention. The exemplary method of installing, assembling and operating the system is described in detail according to the preferred embodiment, without attempting to describe all the various forms and modifications in which the invention might be embodied. As such, the embodiments described herein are illustrative, and as will become apparent to those skilled in the art, can be modified in numerous ways within the scope and spirit of the invention, the invention being measured by the appended claims and not by the details of the specification.

Although the following text sets forth a detailed description of numerous different embodiments, the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, subparagraph (f).

For purposes of this disclosure, it is helpful to present and define certain material terms relevant in the art of wagering and, more specifically, tournament poker or related card games. Capitalized terms used herein, and terms not otherwise defined herein shall have the meanings set forth herein.

Explanation of Game

A poker tournament ("Tournament") is a tournament where players compete by playing a variety of a poker card game. It can feature as few as two players playing on a single table (called a "heads-up" tournament), and as many as tens of thousands of players playing on thousands of tables. The winner of the tournament is usually the person who wins every poker chip in the game and the others are awarded places based on the time of their elimination. To facilitate this, in most tournaments, blinds rise over the duration of the tournament. Unlike in a cash game, a player's chips in a tournament cannot be cashed out for money and serve only to determine the player's placing.

To enter a typical Tournament, a player pays a fixed amount ("Buy-in") and at the start of play is given a certain quantity of tournament poker chips ("Chips"). The value of the players Chips at a given moment is sometimes referred to as the players "Bank roll." Commercial venues typically charge a separate fee or withhold a small portion of the Buy-in, as the cost of running the event. Chips have only notional value; they have no cash value, and only the Chips, not cash, may be used during play. Typically, the amount of each entrant's starting Chips is an integer multiple of the buy-in. Some tournaments offer the option of a re-buy or buy-back ("Re-buy"); this gives players the option of purchasing more Chips. In some cases, Re-buys are conditional (for example, offered only to players low on or out of Chips) but in others they are available to all players ("Add-ons"). When a player has no chips remaining (and has exhausted or declined all Re-Buys, if any are available) he or she is eliminated from the tournament.

The most common playing format for poker Tournaments is the "freezeout" format. All players still playing in a tournament constitute a dynamic pool. Whenever a player loses all his chips and gets eliminated, his table shrinks. In a multi-table Tournament, to combat the constant shrinking of tables and avoid having tables play with varying numbers of players, players are moved between tables, with unnecessary tables getting closed as the tournament progresses. In the end, all remaining players are seated on just one table, known as the "final table." In most tournaments, the number of players at each table is kept even by moving players, either by switching one player or (as the field shrinks) taking an entire table out of play and distributing its players amongst the remaining tables.

Most Tournaments feature one dedicated form of stud or community card poker, such as seven-card stud, seven card high-low stud, Omaha Hold 'em or Texas Hold 'em. Both Omaha and Texas Hold'em Tournaments are commonly offered in fixed-limit and pot limit. There are many variations when dealing with Tournament poker. One popular format is the traditional "knockout" or "bounty" variant where usually ⅓ or ½ of the Prize Pool (i.e. the aggregate of all Buy-ins, less the fee) is dedicated towards a bounty-based side bet and the remaining prize pool is distributed based on placement like a regular tournament. A bounty side-bet ("Bounty") is attributed to each player and "rides along" with the player throughout the course of the tournament. In a standard knockout format, each player starts with the same bounty which remains constant the same through the entirety of the tournament. For example, if a Tournament Buy-in (less the entrance fee) is $100 and one-third of the of the prize pool is ear-marked for the Bounty, $67 will go to the general prize pool and $33 will go towards the Bounty prize pool. The player that eliminates another player collects the Bounty associated with the eliminated player, which Bounty is then added to the eliminating player's Chips. The knockout dynamic rewards aggressive play and makes the Tournament more action packed than the regular Tournament format that many players otherwise find to be slow paced. Specifically, the Bounty incentive will encourage players with a perceived stronger hand to take greater chances to eliminate other players by engaging in more "all-in" scenarios.

One issue that arises in the Knockout Format is that the Bounty associated with each player remains constant throughout the tournament. This leads to players losing interest in collecting Bounties the longer the duration of the Tournament because the amount of a given Bounty represents a decreasingly small percentage of the overall Tournament Prize Pool. For example, the $33 bounty is not worth chasing when first place is paying $5,000 and only six people remain. Accordingly, the concept of "progressive" knockout poker ("PKP") attempts to address the issues with "standard" knockout systems.

In a PKP Tournament, the Prize Pool is still initially split between bounties and placement but only a portion of the Bounty associated with a player is credited to the eliminating player's Bank Roll. The remainder of the eliminated player's Bounty is then added to the eliminating player's Bounty, thereby making the eliminating player (the perceived stronger player) more valuable to others as a knockout. For example, with a $100 Tournament Buy-In per player, $50 goes toward the general Prize Pool and $50 will go towards each players Bounty. When a player is eliminated, the eliminating player will be awarded $25 to his Bank Roll with the remaining $25 going toward the eliminating player's bounty value, thereby making the eliminating player's Bounty worth $75 going forward. The winner of a PKP Tournament will collect the general Prize Pool amount awarded for first place, plus whatever Bounties the player earned over the course of the event and will get to keep the full amount of their own Bounty. Since the average Bounty values will progressively increase throughout the tournament, the Bounty awards will remain high enough relative to the general prize pool payouts such that players are incentivized to play aggressively thought out the entire tournament instead of just the beginning stages. Given the intricacies of Knockout variants of poker Tournament, particularly PKP, tracking and gameplay management can become difficult because the Tournament operators must not only track the traditional poker game aspects, but also the Bounty aspects of the game. In a traditional live Tournament setting, Bounties would generally be tracked by a deal or tournament director by pencil-and-paper or other manual means. In many cases live poker Tournaments will avoid introducing Knockout or PKP aspects due to overall difficulties with managing and tracking the game. Accordingly, the present invention attempts to address these management difficulties by implementing a digital system and method for tracking the Knockout and/or PKP aspects of an otherwise live, in-person poker Tournament.

System and Network

FIG. 1 illustrates one embodiment of a local area system that facilitates management and execution of the Knockout and PKP functionality and features described herein. The system includes a plurality of player devices 200 used by poker players seated around a gaming table 100. Also seated at the gaming table 200 is a dealer that utilizes a dealer device 300. A Tournament Director utilizes a director device 400, which may be located onsite in the gaming location, or in a remote location. The player device 200, dealer device 300, and director device 400 have increasing functionality and administrative rights as will be further described herein. In some embodiments, the devices 200, 300, and 400 are managed by a server 500. The server 500 can be remotely or locally situated. The devices 200, 300, and 400 and server 500 communicate between and among each either via a communications network 600. The communications network 600 may comprise a local area network (LAN) or a wide area network (WAN), such as the Internet.

A casino gaming environment ("The Environment") poses most of the risk to the devices being discussed. Drinks, food, fast movement by both gaming employees, and players alike all present risk to the devices. Accordingly, the follow non-inclusive specifications apply across the various player, dealer, and director devices (200, 300, and 400) employed herein.

In some embodiments, the display is designed to withstand both blunt force, and pinpoint-pressure force attacks. Accordingly, the display may comprise a chemically strengthened glass materials, such Corning Gorilla Glass which is generally thing, light, and damage resistant.

Viewing angle is also an important characteristic of the display of the devices of the present invention. The larger the viewing angle, the more players seated around a table will be able to see the information on the display clearly. This is essential technology for the player devices 200, as this is where the viewing angle matters the most in that every other player should ideally be able to view each of the other player's player devices 200 in order to appraised of current Bank Roll and Bounty status of each such player. In some embodiments, the player devices 200 each have an expanded 89-degree viewing angle, with +/−1-degree tolerance.

The Environment features bright, neon, and sometimes flashing, pulsing, and glaring lights. As such, it's important to remember that both players and dealers need to be able to clearly see their displays (and the displays other players devices 200) under any lighting conditions. Accordingly, in some embodiments the displays of the devices include an anti-glare treatment or screen protector. In some embodiments, the devices feature adaptive backlighting capabilities that will automatically brighten and darken the screen to optimal viewing levels, based upon the ambient light.

In some embodiments, the devices are comprised a high strength and high durability encasement such as steel or high-impact ABS plastics (mainly polyethylene), these casings are able to withstand, again, both blunt-force, and pinpoint-pressure force attacks of various types, and pressure ratings. Casing made from magnesium provide the shockproofing necessary to allow internal components to survive 6+ foot falls. Additionally, the casing and device design is, in some embodiments, waterproof or water-resistant to known Ingress Protection (IP) code standards. The devices may also employ removable cases such as rubberized bumpers, skins, and the like.

The devices can each be powered by an external power source (such as mains power or a power bank or ABS) or an internal power source such as a battery. In some embodiments, the devices include a LiFePO 4 battery (Lithium Iron Phosphate/Lithium FerroPhosphate) that carries 59.2 W/hrs and can provide a 32-hour standby time. Given actual usage, it's expected to provide at least 20 hours on its own.

Security concerns include both physical device security, as well as attacks on the underlying software. Physical device security for the devices can be accomplished by way of a wire or cord tether attached to the USB port at the bottom of the device. Virtual device security is achieved by operating system, and other low-level services to help thwart attacks on the underlying software. Further security concerns are addressed within the software itself.

In some embodiments, the player device 200 is a simple computing or mobile computing device with limited features (such as an Adafruit PyPortal) that run game management software that displays the player's personal information and current bankroll holdings and Bounty information. In some embodiments, the player device 200 features a 5.2-inch Gorilla Glass® 3 display, a 2.2 Ghz Qualcomm Snapdragon 660 Octa-Core processor, 16 GB RUM, a magnesium alloy case, and an internal 24.2 W/hr battery capable of delivering up to 10 hours of continuous heavy usage. In another embodiment, the player device 200 comprises a 5.2-inch Gorilla Glass® 3 display, an Intel Qualcomm Snapdragon Quad Core processor, 16 GB ROM, a magnesium alloy case, and an internal 24.2 W/hr battery capable of delivering 8 hours of continuous heavy usage. For connectivity, the player device 200 includes a wireless communications module such as Intel's Dual Band AC 8260 WiFi Plus WiFi network component. In other embodiments, the player device 200 may use Bluetooth or a wired connection.

The dealer device 300 is more a more advanced computing or mobile computing device (such as an iPad Pro) and runs game management software that allows the dealer to administer the game. The tournament director device 400 is similar or identical to the dealer device except the software has additional administrative features to allow the director to have more oversight and control of the game. In one example, the dealer and director devices 300 and 400 comprise a 12.27-inch cabinet, 12-inch Gorilla Glass® 3 display, an 8th gen Core i7 vPro processor, 8 GB RAM, 64 GB SATA HDD, a magnesium alloy case, an internal 39.2 W/hr battery capable of delivering 8 hours of continuous heavy usage, and an external 59.2 W/hr battery capable of delivering an additional 20 hours of continuous heavy usage. In another embodiment, the dealer and director devices 300 and 400 can comprise 10-inch cabinet, 10.1-inch Gorilla Glass® 3 display, an Intel Bay Trail E3850 1.9 Ghz processor, 4 GB RAM, 16 GB SATA HDD, a magnesium alloy case, an internal 39.2. W/hr battery capable of delivering 8 hours of continuous heavy usage, and an external 59.2 W/hr battery capable of delivering an additional 20 hours of continuous heavy usage. For connectivity, the dealer and director devices 300 and 400 include a wireless communications module such as Intel's Dual Band AC 8260 WiFi Plus® WiFi network component. In other embodiments, a Bluetooth or a wired connection may be used.

The server 500 can be an x86-compatible unit running Ubuntu or similar linux-based operating systems. In some embodiments, an Ubuntu Linux Server Command Line Install (CLI) is going to be the standard server software used to "host" the software, in any installation. Using a Linux server in this fashion allows for an extremely efficient server operating environment, when compared to other server software that typically employ a graphical user interface (GUI). In some embodiments, the server 500 has the following specifications: Ubuntu Linux 18.0.4.3 LTS (August, 2019 Release); MySQL Server 8.0.17 OR Percona Server for MySQL 8.15.6; Server-Side Components; Revision 1.1.129-10/17/2019; Node.js 10.16.3; NGINX web server software; 4 GB RAM; 2×256 GB (or larger) NVMe/M.2 SSD in AHCI configuration (using GRUB nvme_load="YES" attribute); Intel i5 (Sandy Bridge or later) 4/6 Core OR AMD Ryzen 5 2600 (or later) 4/6 Core; 1U Chassis (if not virtual).

Software

As noted above, each of the devices run game management software and offers a particular feature set depending on which type of device the software is running. The main functionality of the software is contained within a backend API, or Application Programming Interface, as it's known. The API is responsible for handling the interaction between the devices (player devices 200, dealer devices 300, and director devices 400), and the server 500. Each device will connect independently to the server 500, through the API. The API will expose functions that allow for features such as authentication & authorization, updating game information, and determining when certain game events have transpired. In some embodiments, the API is constructed via a Node.js application running on the server 500. The Node.js software can implement a GraphQL API that allows for the return of succinct data.

In some embodiments, each of the device runs a unique version of the API with varying levels of authentication, authorization, and administrative access. For example, in some embodiments the dealer device 200 has the lowest level of credentials and administrative access as it need only to receive and display a limited amount of information such as player biographical data, Bounty data, Bank Roll data, standings data, time seated data or combinations thereof.

The dealer device 300, in some embodiments, has an intermediate level of credentials and administrative access as in some cases the dealer needs only to manage and track the activity at the dealer's table. Accordingly, the software executing on the dealer device is configured to send, receive, and modify a variety of data including player biographical data, Bounty Data, Bank roll data, standings data, time seated data and combinations thereof for all of the players are the dealers table.

The director device 400, in some embodiments, has the highest level of credentials and administrative access given that the director needs to manage and track both dealers and players and, in the case of a multi-table tournament, dealers and players across a plurality of tables. Accordingly, the software executing on the dealer device is configured to send, receive, and modify a variety of data including player biographical data, Bounty Data, Bank roll data, standings data, time seated data and combinations thereof for all of the players across the entirety of the Tournament. In addition, in some embodiments, the director device can send and receive dealer-related data to track and manage the activities of the dealers while also tracking and managing the activities of the players.

Another portion of the software will run online (for example on a Digital Ocean server instance) to enable leaderboard functionality by receiving and displaying either or both live, in-game standings or long-term standings over the course of a Tournament or series of Tournaments. This functionality will allow the game to transcend casino and card room floors.

Example Data Flow

Figure 2:
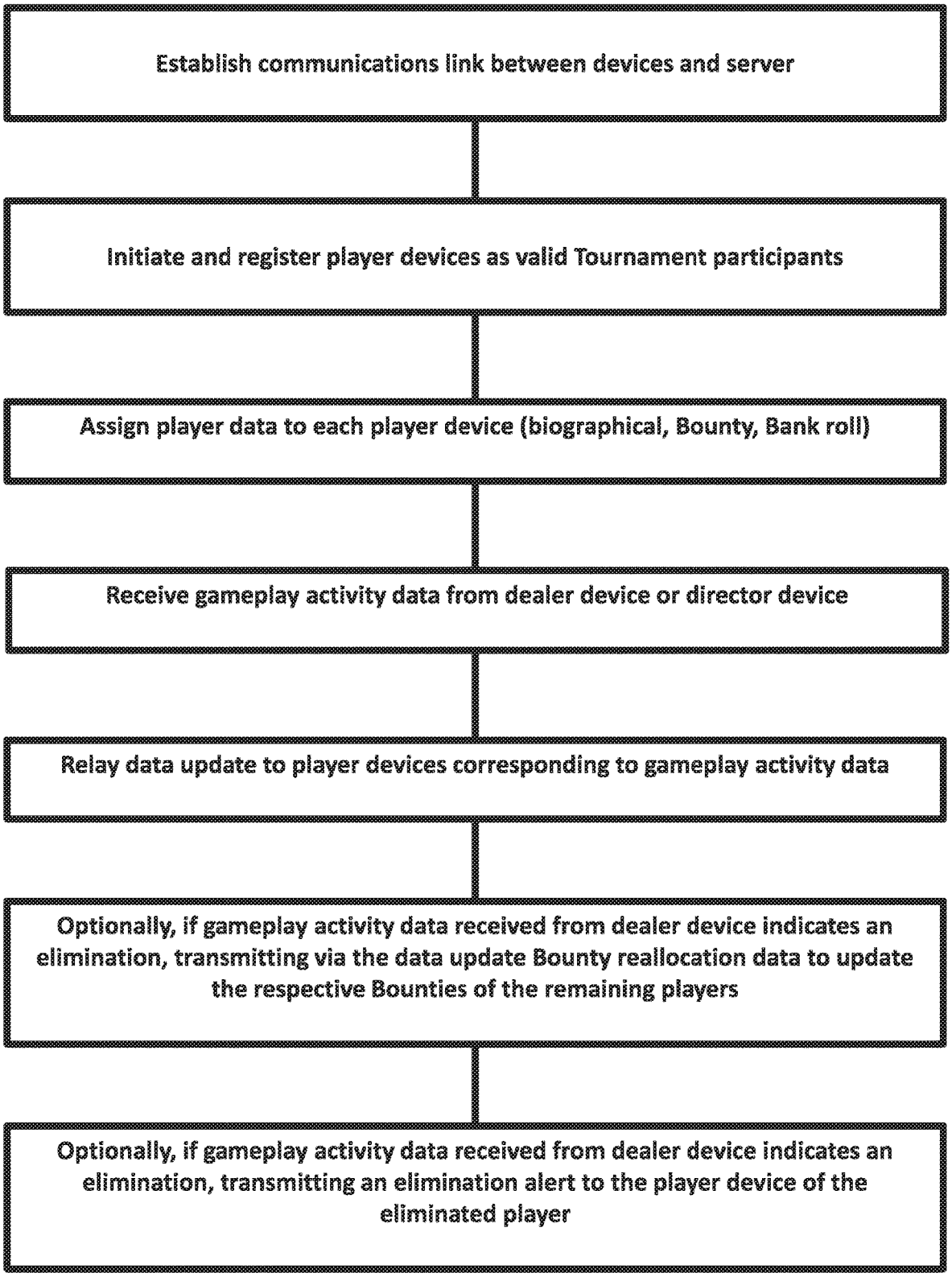

With reference to FIG. 2, shown is an example of the method steps from the perspective of the server 500 according to one embodiment wherein each of the applicable devices is running the game management software via the API described above. A communications link is established between a plurality of player devices 200, dealer devices 300, and director devices 400 and the server 500. The server 500 receives a request from a dealer device 300 or director device 400 an commence or open a Tournament.

The server 500 then initiates and registers each applicable player device 200 as a valid participant in the Tournament. The server 500, based on information received from the dealer device 300 or director device 400, assigns applicable player biographical data, Bounty Data, Bank roll data to each player device 200, which applicable information is then displayed on the appropriate player device 200. The Tournament then commences, in real time in the gaming setting or Environment. The dealer and/or director utilizes their respective devices 300 and 400 to manage and track the ongoing Tournament, including Bounty activities and actions in the context of a Knockout or PKP format. For example, if a player is eliminated, the dealer uses the dealer device 300 to enter an elimination, which allocates the eliminated player's Bounty to the player that won the hand. The dealer device 300 generates gameplay activity data based on input from the dealer which is sent by the dealer device 300 and received by the server 500, which server 500 relays a data update corresponding to the gameplay activity data to the appropriate player devices 200 to reflect the reallocation. In the case of an eliminated player, the data update can trigger an elimination alert on the player device 200 of the eliminated player, which turns off or disables that player device 200. The dealer can use the dealer device 300 to track and manage each active player's Bank roll by entering current Bank roll data associated with one or more player, which Bank roll data is transmitted to the server 500 and then passed to the player devices 200 via a data update. Other information such as player biographical data can be modified and updated in similar fashion. In some embodiments, server 500 can receive a Tournament start time stamp from the dealer device 300, which Tournament start time is used to track the duration of the Tournament. Based on the Tournament start time, the server 500 can transmit Tournament duration data back to the dealer device 300 and to the player devices 200 so that the Tournament participants can be appraised of the duration of the Tournament.

Figure 3:
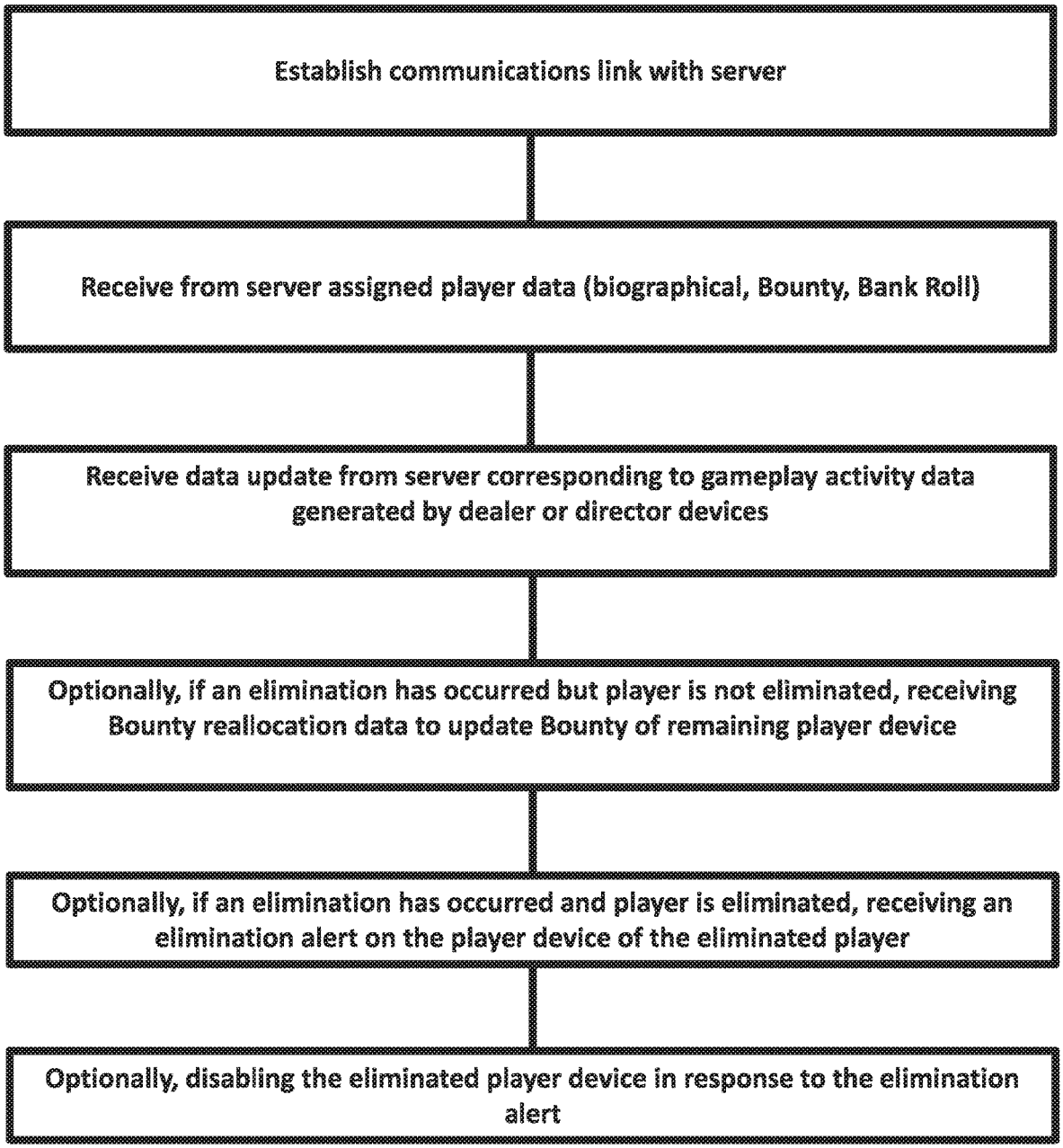

With reference to FIG. 3, shown is an example of the method steps from the perspective of the player device 200 according to one embodiment. A communications link is established between a plurality of player devices 200, dealer devices 300, and director devices 400 and the server 500. The server 500 receives a request from a dealer device 300 or director device 400 an commence or open a Tournament.

The server 500 then initiates and registers each applicable player device 200 as a valid participant in the Tournament. Based on information sent from the dealer device 300 or director device 400 to the server 500, each player device 200 receives from the server 500 applicable player biographical data, Bounty Data, Bank roll data. The player device 200 then displays applicable information corresponding to the data received from the server 500. The Tournament then commences, in real time in the gaming setting or Environment. The dealer and/or director utilizes their respective devices 300 and 400 to manage and track the ongoing Tournament, including Bounty activities and actions in the context of a Knockout or PKP format. For example, if a player is eliminated, the dealer uses the dealer device 300 to enter an elimination, which then allocates the eliminated player's Bounty to the player that won the hand. The elimination or other Bounty activity is then transmitted to the server 500, which server 500 generates a data update. The player device 200 receives the data update corresponding to the reallocation. Update information is displayed on the player device 200 which correspondence to the data update received from the server 500. In the case of an eliminated player, the data update can trigger an elimination alert on the player device 200 of the eliminated player, which turns off or disables that player device 200.

Similarly, the dealer can use the dealer device 300 to track and manage each active player's Bank roll by entering current Bank roll data associated with one or more player, which Bank roll data is transmitted to the server 500 and received by player devices 200 via a data update. Other information such as player biographical data can be modified and updated in similar fashion. In some embodiments, server 500 can receive a Tournament start time stamp from the dealer device 300, which Tournament start time is used to track the duration of the Tournament. The player devices 200 received Tournament duration data from the server 500 so that each player can be appraised of the duration of the Tournament.

It is noted and appreciated that the functions of the dealer device 300 described herein can also be carried out by a director device 400 and, additionally, the director device 400 can be utilized to manage data across a plurality of tables, for example in a multi-table Tournament setting. Additionally, the director device 400 can be utilized by a tournament director to track, manage, and audit the dealer devices 300 for security purposes and otherwise to assure dealers and players are complying with applicable rules and regulations. In this way, it is apparent that the player device 200, dealer device 300, and director device 400 have increasing levels of credentials and administrative access in order to facilitate the appropriate roles and duties of each participant. Moreover, in some embodiments, the player device 200 only offers output functionality, i.e. the displaying of certain data, and has limited or no input functionality in order to maintain the integrity of the system throughout the course of the Tournament.

Explanation of Computing Environment

Figure 4:
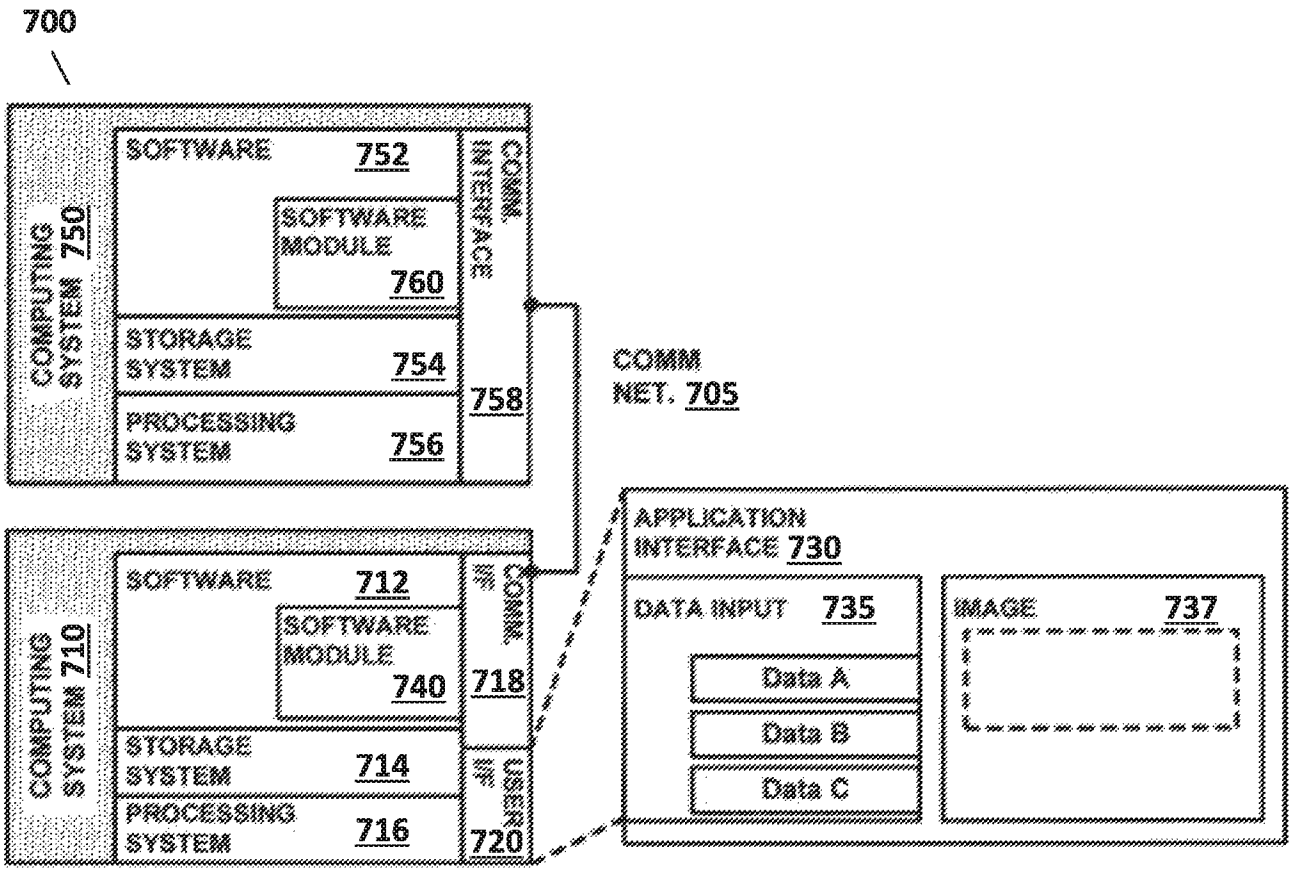

FIG. 4 illustrates a computing environment 700 according to one embodiment. Computing environment 700 includes computing system 710 and computing system 750. Computing system 710, in the present example, corresponds to devices (player devices 200, dealer devices 300, and director devices 400) that can send and receive data and information, and computing system 750 corresponds to system server 500 that can also send and receive data and information. Computing system 710 can include any smart phone, tablet computer, laptop computer, or other computing or mobile device capable of reading, and/or recording data about systems, devices, locations, and/or equipment, etc. Computing system 750 can include any server computer, desktop computer, laptop computer, or other device capable of storing and managing data communication by and between one or more computing systems 710 and other similar computing systems. Either system 710 or 750 can be capable of accomplishing any of the steps of functions described in this description.

In FIG. 4, computing system 710 includes processing system 716, storage system 714, software 712, communication interface 718, and user interface 720. Processing system 716 loads and executes software 712 from storage system 714, including software module 740. When executed by computing system 710, software module 740 directs processing system 716 to receive data, images, devices, locations, and/or equipment, etc. Such data could include any of the information described above, including but not limited to the functionality described herein.

Although computing system 710 includes one software module in the present example, one or more modules could provide the same operation. Similarly, the computing systems may be distributed using other computing systems and software.

Additionally, computing system 710 includes communication interface 718 that can be further configured to transmit data to and receive data from computing system 750 using communication network 705 (which represents the communications network 600 show in FIG. 1). Communication network 705 could include a local area network, the Internet, cellular network, satellite network, RF communication, blue-tooth type communication, near field, or any other form of communication network capable of facilitating communication between computing systems 710 and 750.

Referring still to FIG. 4, processing system 716 can comprise a microprocessor and other circuitry that retrieves and executes software 712 from storage system 714. Processing system 716 can be implemented within a single processing device but can also be distributed across multiple processing devices or sub-systems that cooperate in executing program instructions. Examples of processing system 716 include general purpose central processing units, application specific processors, and logic devices, as well as any other type of processing device, combinations of processing devices, or variations thereof. Storage system 714 can comprise any storage media readable by processing system 716, and capable of storing software 712. Storage system 714 can include volatile and nonvolatile, removable and non-removable media implemented in any method or technology for storage of information, such as computer readable instructions, data structures, program modules, or other data. Storage system 714 can be implemented as a single storage device but may also be implemented across multiple storage devices or sub-systems. Storage system 714 can comprise additional elements, such as a controller, capable of communicating with processing system 716.

Application interface 730 can include data input 735 and image display 737. In one example, data input 735 can be used to collect information and data inputs from the user. It should be understood that although computing system 710 is shown as one system, the system can comprise one or more systems to collect data.

Computing system 750 includes processing system 756, storage system 754, software 752, and communication interface 758. Processing system 756 loads and executes software 752 from storage system 754, including software module 760. When executed by computing system 750, software module 760 directs processing system 710 to store and manage the data from computing system 710 and other similar computing systems. Although computing system 710 includes one software module in the present example, it should be understood that one or more modules could provide the same operation.

Additionally, computing system 750 includes communication interface 758 that can be configured to send and receive data to and from computing system 710 using communication network 705.

Referring still to FIG. 4, processing system 756 can comprise a microprocessor and other circuitry that retrieves and executes software 752 from storage system 754. Processing system 756 can be implemented within a single processing device but can also be distributed across multiple processing devices or sub-systems that cooperate in executing program instructions. Examples of processing system 756 include general purpose central processing units, application specific processors, and logic devices, as well as any other type of processing device, combinations of processing devices, or variations thereof.

Storage system 754 can comprise any storage media readable by processing system 756, and capable of storing software 752 and data from computing system 710. Data from computing system 710 may be stored in a word, excel, or any other form of digital file. Storage system 754 can include volatile and nonvolatile, removable and non-removable media implemented in any method or technology for storage of information, such as computer readable instructions, data structures, program modules, or other data. Storage system 754 can be implemented as a single storage device but may also be implemented across multiple storage devices or sub-systems. Storage system 754 can comprise additional elements, such as a controller, capable of communicating with processing system 756.

Examples of storage media include random access memory, read only memory, magnetic disks, optical disks, flash memory, virtual memory, and non-virtual memory, magnetic cassettes, magnetic tape, magnetic disk storage or other magnetic storage devices, or any other medium which can be used to store the desired information and that may be accessed by an instruction execution system, as well as any combination or variation thereof, or any other type of storage media. In some implementations, the storage media can be a non-transitory storage media. In some implementations, at least a portion of the storage media may be transitory. In no case is the storage media a propagated signal.

In some examples, computing systems 710 and 750 an include a user interface. The user interface can include a mouse, a keyboard, a voice input device, a touch input device for receiving a gesture from a user, a motion input device for detecting non-touch gestures and other motions by a user, and other comparable input devices and associated processing elements capable of receiving user input from a user. Output devices such as a graphical display, speakers, printer, haptic devices, and other types of output devices may also be included in the user interface. The user input and output devices are well known in the art and need not be discussed at length here.

The included descriptions and figures depict specific implementations to teach those skilled in the art how to make and use the system and method described herein. For the purpose of teaching inventive principles, some conventional aspects have been simplified or omitted. Those skilled in the art will appreciate variations from these implementations that fall within the scope of the invention. Those skilled in the art will also appreciate that the features described above can be combined in various ways to form multiple implementations. As a result, the invention is not limited to the specific implementations described above, but only by the claims and their equivalents.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the present disclosure has included description of one or more embodiments and certain variations and modifications, other variations and modifications are within the scope of the disclosure, e.g., the use of a certain component described above alone or in conjunction with other components may comprise a system, while in other aspects the system may be the combination of all of the components described herein, and in different order than that employed for the purpose of communicating the novel aspects of the present disclosure. Other variations and modifications may be within the skill and knowledge of those in the art, after understanding the present disclosure. This method of disclosure is intended to obtain rights which include alternative embodiments to the extent permitted, including alternate, interchangeable and/or equivalent structures, functions, ranges or steps to those claimed, whether such alternate, interchangeable and/or equivalent structures, functions, ranges or steps are disclosed herein, and without intending to publicly dedicate any patentable subject matter.

What is claimed is:

1. A system for managing and tracking progressive knockout poker in a live poker tournament gaming setting, comprising:

a plurality of player devices each associated with an entrant in the live poker tournament gaming setting, the player devices in data communication with at least one dealer device, the dealer device associated with a dealer in the live poker tournament gaming setting, wherein the dealer device manages bounty and bankroll information associated;

a server establishing data communication between the player devices and the dealer device;

wherein each of the player and dealer devices run game management software administered by an application programming interface;

wherein the dealer device has a higher level of administrative access than the player device;

wherein the server assigns player data to each player device corresponding to each of the entrants, the player data including data corresponding to the bounty associated with each of the entrants;

wherein the server receives gameplay activity data from the dealer device; and wherein the server relays to at least one player device a data update corresponding to the gameplay activity received from the dealer device.

2. The system of claim 1, including a director device to manage and track the one or more dealer device, wherein the director device has a higher level of administrative access than the dealer device.

3. The system of claim 2, wherein the server, player devices, dealer device, and director device are interconnected by a communications network.

4. The system of claim 3, wherein the communications network is a local area network.

5. The system of claim 3, wherein the communications network is a wide area network.

6. A method for managing and tracking progressive knockout poker in a live poker tournament gaming setting, comprising:

providing a plurality of player devices, each associated with an entrant in the live poker tournament gaming setting, the player device;

providing at least one dealer device associated with a dealer in the live poker tournament gaming setting wherein the dealer device has a higher level of administrative access than the player device;

providing a server;

running on each of the player devices and the dealer device game management software administered by an application programming interface;

establishing a communications link between the players devices and the dealer via the server;

assigning from the server player data to each player device corresponding to each of the entrants, the player data including data corresponding to the bounty associated with each of the entrants;

receiving on the server gameplay activity data from the dealer device; and relaying from the server to at least one player device a data update corresponding to the gameplay activity received from the dealer device.

7. The method of claim 6, further comprising the step of: if game play activity data received from the dealer device indicates that an entrant has been eliminated, transmitting via the data update bounty reallocation data to update the respective bounty associated with at least one non-eliminated player.

8. The method of claim 6, further comprising the step of: if game play activity data received from the dealer device indicates that an entrant has been eliminated, transmitting via the data update an elimination alert to the player device of the eliminated player.

9. The method of claim 8, further comprising the step transmitting via the data update a disable signal to disable the player device of the eliminated player.

10. The method of claim 6, including a director device to manage and track the one or more dealer device, wherein the director device has a higher level of administrative access than the dealer device.

11. The method of claim 6, wherein the communications link is established over a communications network.

12. The method of claim 11, wherein the communications network is a local area network.

13. The method of claim 11, wherein the communications network is a wide area network.

14. A method for managing and tracking progressive knockout poker in a live poker tournament gaming setting, comprising:

providing a plurality of player devices, each associated with an entrant in the live poker tournament gaming setting;

providing at least one dealer device associated with a dealer in the live poker tournament gaming setting wherein the dealer device has a higher level of administrative access than the player device;

providing a server;

running on each of the player devices and the dealer device game management software administered by an application programming interface;

establishing a communications link between the players devices and the dealer via the server;

receiving on each player device player data corresponding to each of the entrants, the player data including data corresponding to the bounty associated with each of the entrants; and receiving on at least one player device a data update corresponding to the gameplay activity data exchanged between the server and the dealer device.

15. The method of claim 14, further comprising the step of: if game play activity data received from the dealer device indicates that an entrant has been eliminated, receiving via the data update bounty reallocation data to update the respective bounty associated with at least one non-eliminated player.

16. The method of claim 14, further comprising the step of: if game play activity data received from the dealer device indicates that an entrant has been eliminated, receiving an elimination alert on the player device of the eliminated player.

17. The method of claim 16, further comprising the step of receiving a disable alert on the player device of the eliminated player.

18. The method of claim 14, including a director device to manage and track the one or more dealer device, wherein the director device has a higher level of administrative access than the dealer device.

19. The method of claim 14 wherein the communications link is established over a communications network.

* * * * *